United States Patent [19]

Schaefer

[11] 4,324,445

[45] Apr. 13, 1982

[54] REFRIGERATING OR WARMING CABINET

[76] Inventor: Rudolf Schaefer, Brauerstr. 35, 4100 Duisburg 1, Fed. Rep. of Germany

[21] Appl. No.: 82,604

[22] Filed: Oct. 9, 1979

[30] Foreign Application Priority Data

Oct. 9, 1978 [DE] Fed. Rep. of Germany ..... 2843972

[51] Int. Cl.[3] ..... A47B 77/08; F16B 12/00

[52] U.S. Cl. ..... 312/236; 312/111; 312/263; 52/264

[58] Field of Search ..... 312/236, 263, 107, 111, 312/264; 62/299; 52/264

[56] References Cited

U.S. PATENT DOCUMENTS

| | | | |
|---|---|---|---|
| 1,465,021 | 8/1923 | Nicolson | 312/236 |
| 2,263,862 | 11/1941 | Usmar | 312/236 |
| 2,838,355 | 6/1958 | Crowther | 312/263 |
| 2,869,953 | 1/1959 | Miller et al. | 312/263 |
| 3,068,939 | 12/1962 | Commisso | 160/380 |
| 3,230,059 | 1/1966 | Kinley | 312/236 |
| 3,507,322 | 4/1970 | Tetrick et al. | 62/299 |
| 3,545,623 | 12/1970 | Andreasson | 312/111 |
| 3,563,624 | 2/1971 | Stice | 312/111 |
| 3,779,623 | 12/1973 | Motohashi | 312/111 |
| 3,870,388 | 3/1975 | LoForen | 312/264 |
| 3,877,764 | 4/1975 | Hillier, Jr. | 312/263 |
| 3,898,779 | 8/1975 | Tracy | 52/264 |
| 3,944,310 | 3/1976 | Welsh | 312/263 |
| 4,171,150 | 10/1979 | Soderlund | 312/263 |
| 4,171,151 | 10/1979 | Luck | 312/236 |

FOREIGN PATENT DOCUMENTS

| | | |
|---|---|---|
| 119563 | 5/1900 | Austria . |
| 1250622 | 9/1967 | Fed. Rep. of Germany . |
| 2242887 | 3/1975 | France . |

*Primary Examiner*—Victor N. Sakran
*Attorney, Agent, or Firm*—Spencer & Kaye

[57] ABSTRACT

A refrigeration or warming cabinet having detachably assembled flat wall elements. On each flat wall element is located a plurality of groove-tongue connections formed in the connecting areas. At least one wall element has, in addition to the groove and/or tongue positions on the front side, grooves and/or tongues on one side surface. The grooves and tongues have an approximate trapezoidal cross section and run continuously along the edges of the wall elements in such a manner that in the corner areas the grooves and/or tongues of the side surfaces of one of the wall elements merges into the tongues and grooves of the front side of another of the wall elements.

6 Claims, 6 Drawing Figures

REFRIGERATING OR WARMING CABINET

CROSS-REFERENCE TO RELATED APPLICATION

Application Ser. No. 956,428 by Rudolf Schaefer, filed Oct. 31, 1978 pertains to related subject matter.

BACKGROUND OF THE INVENTION

The invention relates to a refrigerating or warming cabinet which is detachably assembled from single flat wall elements, having groove-tongue connections formed in the connecting areas.

SUMMARY OF THE INVENTION

A container of this type known from the Austrian Pat. No. 119 563 serves as a refrigerator and is built up from single parts in a unit-composed way. The wall elements herein are fastened together by way of hooks.

The wall elements are covered in the area of the grooves and tongues with sealing material in order to provide insulation in these edge areas. The solidity of this known refrigerator is most unsatisfactory, this being maintained by hooks alone. Neither is the insulation in the bordering edge area sufficient, at least over a longer period of time, since from experience elastic sealing material loses its elasticity after some time so that the insulating effect diminishes accordingly. The assembly is also tedious since the grooves and tongues, which are rectangular in cross-section, are difficult to join in place.

The object of the invention is to construct a container of the above mentioned type in such a way that it is more easily assembled and taken apart again and has a complete and lasting impermeability when assembled.

Energy-saving, easily assembled, insulating climatic storage cells, which are by water and/or steam operated, are created up to high capacity which are connected into the supply pipe network and use the energy therein before and/or after use.

Preferably, it is proposed that the wall elements are held together by means of two clamping bands which encircle the cabinet body and can be closed by a releasable lock. In such a construction the actual cabinet body has a very high degree of solidity, when assembled, even when in addition to the groove and tongue connections only clamping bands are used. As these can be handled considerably more easily than hooks or screw connections, the assembly and also the dismantling of the container is correspondingly simple. A good insulating effect is also provided in the connecting area of the edges in wall elements manufactured from suitable insulating plastic without, additional insulating strips having to be inserted. Since it is possible to produce the grooves and tongues on the wall elements by machine without great expense, the container can be manufactured at a low price.

It is of further advantage that two clamping bands are provided which each run around the cabinet body in a plane in which the two wall elements provided with grooves and tongues on their narrow sides lie. The tension force from the clamping bands is therefore only effective in the plane of those wall elements where the grooves and tongues run in the narrow sides as well as on the two remaining wall elements in directions running vertically to this plane. However, no force components occur which could cause one of the wall elements to be pressed out of the right-angled relationship.

The cabinet body favorably produced in the above way is converted into a refrigerator without its own cooling aggregate by conducting the drinking water removed from the rising mains in the basement through it. The proposed assembly of the refrigerator or several refrigerators forming a battery in the basement of the house guarantees a high cooling capacity.

In the same way the entire waste hot water flowing off (e.g. from washing machine or dishwasher etc.) can be directed through a relay before it reaches the drain, through corresponding heat and/or cooling regenerators (without refitting the equipment) and be used, for example, for the following sectors:

(a) in the catering trade: storage of foodstuffs and delicacies, particularly of wines, or for keeping the crockery warm;

(b) in canteens, works kitchens etc.: for keeping meals warm;

(c) in laboratories in research centres and clinics for breeding cultures etc.;

(d) in private households: for thawing out frozen food and drying washing—a problem in large families in cold and humid rooms.

Large-capacity dry cells are made by assembling a drying chamber in which corresponding heat regenerators are present. These heat regenerators are connected to a separate hot water outlet pipe. This can be installed without great extra cost in new buildings. Such energy-saving equipment can also be installed in old buildings.

Further advantageous developments of the invention are given in the sub-claims.

An embodiment of the invention is shown in the drawings and is described in more detail below.

DESCRIPTION OF THE PREFERRED EMBODIMENTS

A first wall element 10 serves as rear side and forms the actual cabinet body with a further four wall elements 11,12,13 and 14, while a further wall element 15 is constructed in the form of a door. All wall elements 10 to 15 are manufactured from a good heat-insulating plastic, e.g. a rigid expanded plastic. They may also be at least partly coated with a plastic film which is not represented here.

Figure 3:
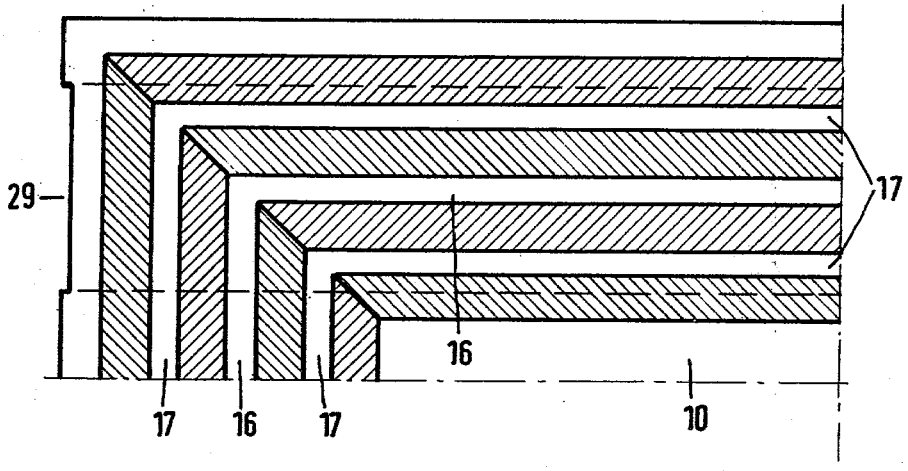
FIGS. 3 to 5 show views of parts of individual wall elements in the area of the groove-tongue connections.
Figure 4:
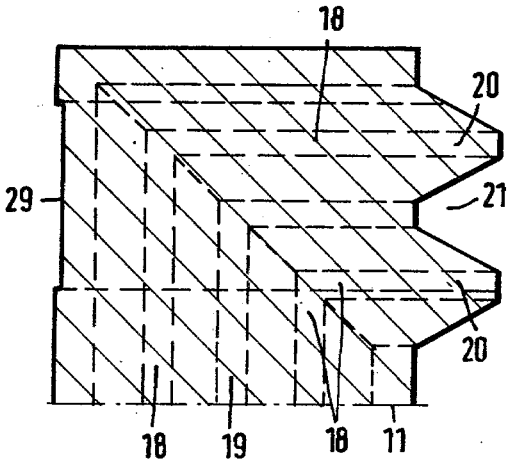
Figure 5:
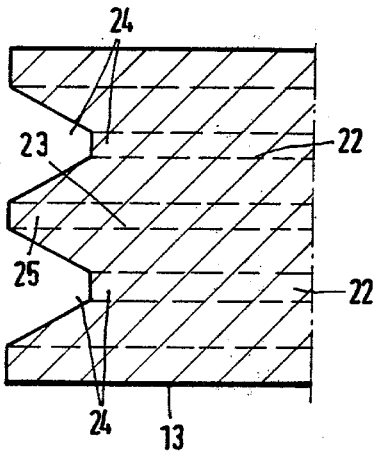

The first wall element 10 forming the back side is provided on its inner side, as can be seen especially from FIG. 3, with continuously encircling grooves 16 and tongues 17 which merge into one another at the corners at an angle of 90°. Two tongues 17 in each case run parallel to each other, whereby a groove 16 is formed between them.

The two wall elements 11 and 12 constructed as side wall each have on their narrow sides set on the first wall element 10 two grooves 18, between which a tongue 19 runs. Wall elements 11 and 12 each have two tongues 20 on their inner sides to be connected with wall elements 13 and 14, said tongues 20 forming a groove or auxiliary groove 21 between them. The latter merges into the tongues 19 on the narrow side facing the first wall element 10, while the tongues 20 merge with the grooves 18 on an equal incline towards the same side.

Conversely, such a changeover is not present in the case of wall elements 13 and 14, as these each have continuously encircling grooves 24 on all four narrow sides which form a tongue or auxiliary tongue 25 between them.

In the respective outer edge areas of the groove-tongue connections the grooves 21 or tongues 25 each have only half the cross-section in comparison with the middle area.

As can be seen from all the figures, the groove-tongue connections have a frusto-conical cross-section. They are moreover constructed in such a way that the assembled wall elements 10 to 15 each always interlock in two directions.

The wall elements 10 to 15 assembled to form a cabinet body are held together by means of two flat clamping bands 26 and 27 of steel which can be closed at their ends by means of a respective clamping lever lock 28 which can be operated easily by hand. On the outer sides of the wall elements 10,11 and 12 correspondingly dimensioned shallow grooves 29 are provided, into which the clamping bands 26 and 27 can be inserted so that they do not project outside and can not slip. The upper clamping band 26, therefore, encloses at the same time the wall element 13 serving as the upper cover plate while the lower clamping band 27 at the same time encloses the wall element 14 serving as base plate or lies in the same plane with this. Thus, the forces from the clamping bands 26 and 27 are transferred in the area of the tongues 20 and grooves 21 of the lateral wall elements 11 and 12 and the grooves 24 and tongues 25 formed on the narrow sides of the upper and lower wall element 13 or 14 in such a manner that the respective wall elements bordering on one another are held together everywhere, thereby closing the form completely, without it being possible for them to be pushed against each other. This leads to a particularly high degree of stability in the assembled cabinet body.

Figure 1:
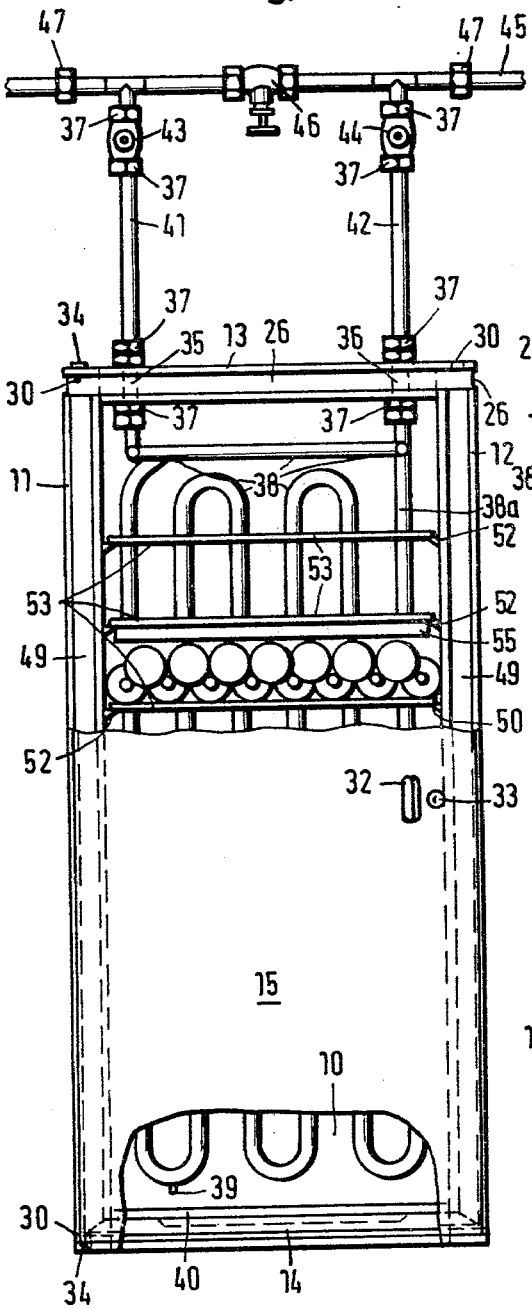
FIG. 1 shows a schematic representation of a front view of a connected refrigerating or warming cabinet.
Figure 2:
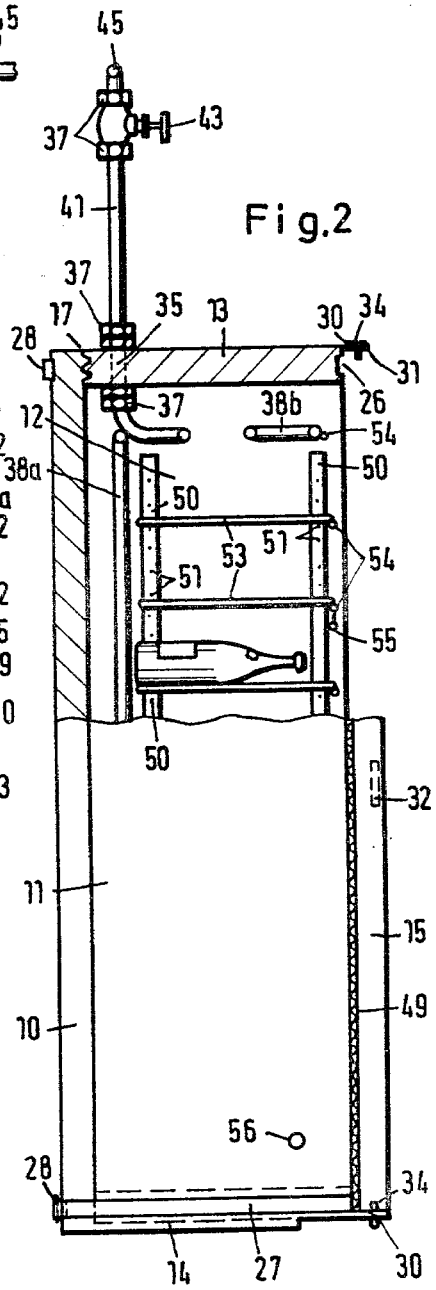
FIG. 2 shows a side view of the representation of FIG. 1.

A bracket 30 which projects forwards and is provided with a bore 31 is attached in each case to the upper and lower narrow sides of the lateral wall elements 11 and 12. The wall element 15 serving as door corresponds in size to the rear wall element 10 and thus fits exactly between the brackets 30. The wall element 15 has a handle 32 and a lock 33 adjacent one longitudinal side; on the opposite impact side bores are arranged on the top and bottom which are possibly reinforced by sleeves or similar and are not shown here in detail. This permits a pin 34 to be directed through each of the bores 31 positioned in two respective brackets 30 lying one above the other, said pin 34 meshing into the bores of the wall element 15 and serving as door hinge. In the case of the embodiment shown in FIG. 1 the wall element 15 is fastened on the left-hand side. It can, if necessary, be turned so that the handle 32 is on the left-hand side and the right-hand brackets 30 serve as door hinge.

The wall element 13 serving as upper cover plate is provided with two passage connecting sleeves 35 and 36, to the inner side of which the two ends of a pipe system 38 serving as cooling aggregate are connected by way of union nuts. The pipe system 38 runs with one part 38*a* along the wall element 10 serving as back side while its other part 38*b* is arranged below the upper wall element 13. An outlet tap 39, by means of which water can be drained into an indentation 40, is provided at the deepest point of a coil of part 38*a*. The indentation 40 is formed in the wall element 14 serving as base plate. If the inside of the refrigerating cabinet is to have a greater air humidity content, then water is introduced accordingly in the bath-shaped indentation 40.

On the ends of the connecting sleeves 35 and 36 projecting upwards two connecting pipes 41 and 42 are connected, also by using union nuts 37, which are connected with a water main 45 by hand valves 43 and 44. In the latter a by-pass valve 46 is connected between the two connection points so that the flow of cold water through the pipe system 38 can be predetermined in the desired way by correspondingly adjusting the three valves 43,44 and 46. This connection area can be easily separated off from the water main 45 by way of detachable coupling sleeves 47. If the refrigerator is to be connected at a different point, then a bridging pipe should be connected. A particularly effective cooling is provided if the refrigerator is connected to the water main 45 before any rising main is branched, so that the entire cold water requirement of an appartment or house can be applied for cooling.

The wall element 15 serving as door covers, as already mentioned, at top and bottom the part of the clamping bands 26 and 27 running there. On each of the two front narrow sides of the lateral wall elements 11 and 12 a steel rail 49 is disposed so that independent of whether the door wall element 15 is attached on the left- or right-hand side, the corresponding parts of the clamping bands 26 and 27 connected with one of the steel rails 49 at any rate form a continuous steel support which can work together with magnets set into the door wall element 15 at a corresponding point as a magnetic lock.

Support rails, 50, which run vertically and parallel to one another and which are provided with distributed openings 51 of the same modular dimension, are attached to the insides of the lateral wall elements 11 and 12. Small support brackets 52 can be suspended in these openings 51 and then carry for their part intermediate bases 53. The latter can thus be arranged at the respective level required and spaced from one another as respectively desired.

In the present case the refrigerator is fitted to store wine bottles. The intermediate bases 53 each have two eyelets 54 on their front edge, on each of which a number board 55 can be hung. The latter can, for example, be printed with numbers which, horizontally, mark the individual storage positions for the bottles. These markings can be made to tally with a correspondingly kept card index, so that the contents of the refrigerator can be surveyed at all times.

Figure 6:
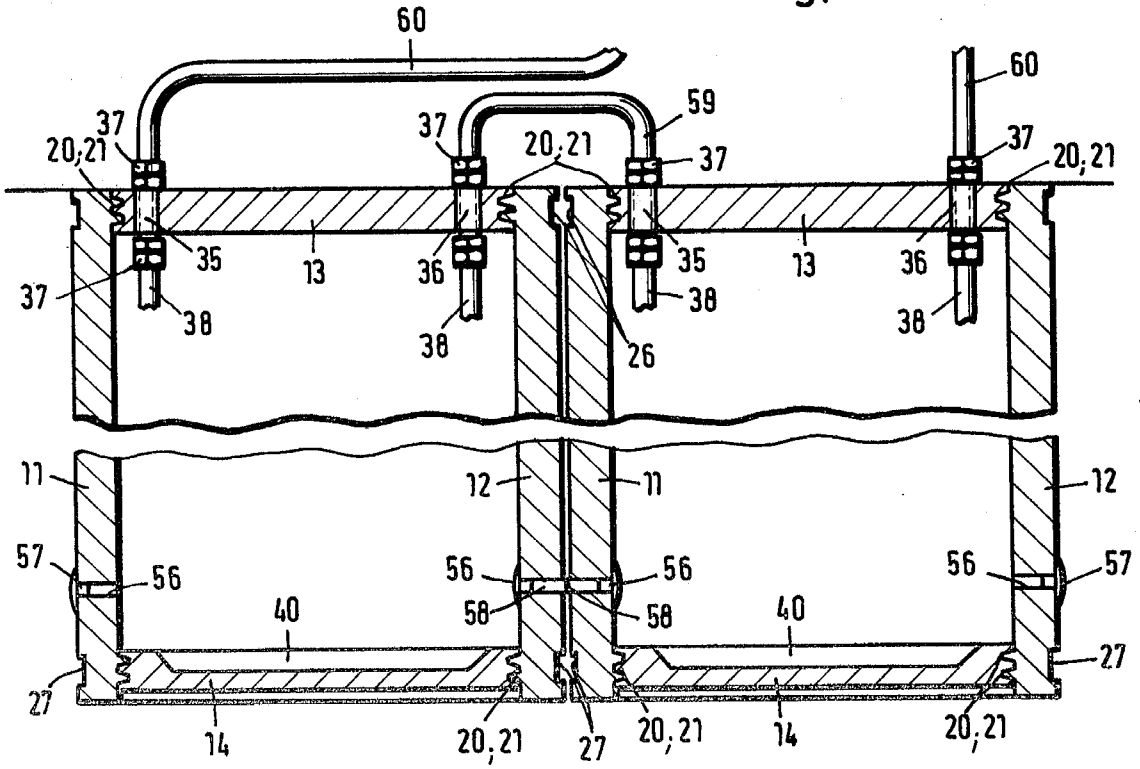
FIG. 6 shows the assembly of two refrigerating or warming cabinets in schematic representation.

FIG. 6 shows how two adjacent refrigerators can be easily connected to one another mechanically and electrically. In the inner area the lateral wall elements 11 and 12 each have a bore 56 which can be closed with a dummy plug 57 composed of insulating plastic material, should a connection with a second refrigerator not come into question on the respective side. However, if this is the case, the dummy plugs 57 of two wall elements 11 or 12 bordering on one another are removed so that a connecting bolt 58 can be directed through and tightened.

As the two pipe systems 38 are connected one behind the other for expedience, a rigid, U-shaped connecting pipe 59 is connected to the output side connection sleeve 36 of the left-hand refrigerator and on the input side connection sleeve 35 of the right-hand refrigerator, said connecting pipe 59 at the same time holds the two refrigerators together in the upper area. Hoses 60 can also be used as connection pipes to the water main 45 (not shown here), which renders the location of the two refrigerators more independent of the position of the respective water main.

As can be seen from this description, assembly and dismantling of the refrigerator can be carried out by anyone without using any tools. With the exception of the wall elements themselves only commonly available materials are needed. But the machine manufacture only demands a small technical expense. They are considerably more favorable in initial cost than the refrigerators previously used. In addition, operation costs, e.g. due to electricity consumption, do not occur for the refrigerator according to the invention.

I claim:

1. The combination of a refrigeration or warming cabinet with a detachably connected wall assembly formed of single flat wall elements coupled in connecting areas by connecting elements cooperating with one another to form groove-tongue connections; at least one wall element having on the front side a first type of connecting element and on a side surface a second type of connecting element; one of the connecting element types being a groove of approximately trapezoidal cross section and the other of the connecting element types being a tongue of approximately trapezoidal cross section; said first and second types of connecting elements running continuously along the wall elements such that in corner zones first and second types of connecting elements on the side surfaces of one of said wall elements merge into respective second and first type of connecting elements on the front side of another of said wall elements; the combination further comprising two clamping bands encircling the cabinet and holding together the flat wall elements and a releasable lock connected to said clamping bands for tightening each clamping band.

2. The refrigeration or warming cabinet as defined in claim 1 where the flat wall elements are provided with shallow recesses in their outer sides in which the clamping bands can be inserted, said recesses being arranged in the bordering edge area in the plane of the upper and lower flat wall elements.

3. The refrigeration or warming cabinet as defined in claim 1 wherein one flat wall element is a door for the cabinet, said door located so that said clamping bands do not interfere with the doors ability to be opened, a magnetic lock for said door, said clamping bands serving as a component part of the magnetic lock.

4. The refrigeration or warming cabinet as defined in claim 3, where the door is provided on opposing sides with bores lying in one axis, brackets bored at the door's end such that the door may be selectively fastened by means of bearing pins to hinge from either the right or left.

5. The refrigeration or warming cabinet as defined in claim 4 where the flat wall elements are made of plastic insulating material.

6. The refrigeration or warming cabinet as defined in claim 5 where the cabinet is provided with an indentation in the bottom flat wall element.

* * * * *